US008528334B2

(12) United States Patent
Dutta et al.

(10) Patent No.: US 8,528,334 B2
(45) Date of Patent: Sep. 10, 2013

(54) FLOW CONDITIONER FOR FUEL INJECTOR FOR COMBUSTOR AND METHOD FOR LOW-NO$_x$ COMBUSTOR

(75) Inventors: Partha Dutta, San Diego, CA (US); Kenneth O. Smith, San Diego, CA (US); Frank J. Ritz, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 1637 days.

(21) Appl. No.: 12/015,366

(22) Filed: Jan. 16, 2008

(65) Prior Publication Data

US 2013/0125548 A1 May 23, 2013

(51) Int. Cl.
*F02C 7/224* (2006.01)
*F23Q 11/04* (2006.01)

(52) U.S. Cl.
USPC ..... 60/723; 60/777; 60/748; 431/268

(58) Field of Classification Search
CPC ..... F23R 3/40
USPC ..... 60/723, 777, 39.822, 736, 737, 740, 60/748, 742; 239/589, 592, 594, 601, 298, 239/399, 403, 406, 416.5, 423, 461, 487, 239/488; 431/268
See application file for complete search history.

(56) References Cited

U.S. PATENT DOCUMENTS 4,559,009 A * 12/1985 Marino et al. ..... 431/184
5,628,181 A 5/1997 Kraemer
5,634,784 A 6/1997 Pfefferle et al.
5,879,148 A 3/1999 Cheng et al.
5,941,698 A 8/1999 Darling et al.
5,958,347 A 9/1999 Roychoudhury et al.
5,964,086 A 10/1999 Kraemer
5,983,622 A 11/1999 Newburry et al.
5,987,875 A 11/1999 Hilburn et al.
6,035,645 A * 3/2000 Bensaadi et al. ..... 60/742
6,048,194 A 4/2000 Pfefferle et al.
6,122,916 A 9/2000 Amos et al.
6,155,819 A 12/2000 Etemad et al.
6,174,159 B1 1/2001 Smith et al.
6,179,608 B1 1/2001 Kraemer et al.
6,268,913 B1 7/2001 Rising
6,270,337 B1 8/2001 Etemad et al.
6,415,608 B1 7/2002 Newburry
6,588,213 B2 7/2003 Newburry (Continued)

OTHER PUBLICATIONS

Karim et al., "Advanced catalytic pilot for low NOx industrial gas engines," Proceedings of ASME Turbo Expo 2002, GT-2002-30083, Amsterdam, The Netherlands, Jun. 3-6, 2002.

(Continued)

*Primary Examiner* — Andrew Nguyen
(74) *Attorney, Agent, or Firm* — Leydig, Voit & Mayer

(57) ABSTRACT

An injector for a gas turbine combustor including a catalyst coated surface forming a passage for feed gas flow and a channel for oxidant gas flow establishing an axial gas flow through a flow conditioner disposed at least partially within an inner wall of the injector. The flow conditioner includes a length with an interior passage opening into upstream and downstream ends for passage of the axial gas flow. An interior diameter of the interior passage smoothly reduces and then increases from upstream to downstream ends.

15 Claims, 4 Drawing Sheets

(56) References Cited

U.S. PATENT DOCUMENTS

| | | | | |
|---|---|---|---|---|
| 6,609,905 | B2 | 8/2003 | Eroglu et al. | |
| 6,619,043 | B2 | 9/2003 | Bruck et al. | |
| 6,630,423 | B2 | 10/2003 | Alvin et al. | |
| 6,662,564 | B2 | 12/2003 | Bruck et al. | |
| 6,666,029 | B2 | 12/2003 | Ryan | |
| 6,698,207 | B1 | 3/2004 | Wiebe et al. | |
| 6,715,295 | B2 | 4/2004 | Gadde et al. | |
| 6,748,745 | B2 * | 6/2004 | Ul Karim et al. | 60/777 |
| 6,775,989 | B2 | 8/2004 | Bandaru et al. | |
| 6,810,670 | B2 | 11/2004 | Bruck et al. | |
| 6,829,896 | B2 | 12/2004 | Bruck et al. | |
| 6,848,260 | B2 | 2/2005 | North et al. | |
| 6,923,001 | B2 | 8/2005 | Laster et al. | |
| 6,966,186 | B2 | 11/2005 | Bachovchin et al. | |
| 7,096,671 | B2 | 8/2006 | Bland et al. | |
| 7,137,258 | B2 * | 11/2006 | Widener | 60/776 |
| 2003/0054300 | A1 | 3/2003 | Castaldi et al. | |
| 2003/0058737 | A1 | 3/2003 | Berry et al. | |
| 2005/0028445 | A1 | 2/2005 | Roychoudhury et al. | |
| 2005/0126755 | A1 | 6/2005 | Berry et al. | |
| 2005/0279862 | A1 * | 12/2005 | Mao et al. | 239/403 |
| 2006/0191269 | A1 | 8/2006 | Smith et al. | |
| 2006/0218932 | A1 | 10/2006 | Pfefferle | |
| 2007/0098604 | A1 | 5/2007 | Smith et al. | |

OTHER PUBLICATIONS

Smith et al., "Rich-catalytic lean-burn for low-single-digit low NOx gas turbines," Proceedings of ASME Turbo Expo 2003: Power for Land, Sea, and Air, GT-2003-38129, Atlanta, Georgia, USA, Jun. 16-19, 2003.

* cited by examiner

FLOW CONDITIONER FOR FUEL INJECTOR FOR COMBUSTOR AND METHOD FOR LOW-$NO_x$ COMBUSTOR

STATEMENT REGARDING FEDERALLY SPONSORED RESEARCH AND DEVELOPMENT

This invention was made in part with the U.S. Government support under Contract DE-FC26-05NT42647 awarded by the Department of Energy to Precision Combustion Incorporated. The Government may have certain rights in this invention.

TECHNICAL FIELD

This patent disclosure relates generally to combustors and burners, and, more particularly to catalytic pilots for low emission gas turbine fuel injectors for use in combustors or burners.

BACKGROUND

Combustion is a major source of a class of pollutants including oxides of nitrogen, or $NO_x$, (NO or nitric oxide, and $NO_2$ or nitrogen dioxide), which may contribute to acid rain, smog, and ozone depletion. $NO_x$ emissions from combustion sources primarily consist of nitric oxide produced during combustion. When utilizing gaseous fuels, combustion processes that decrease the combustion temperature can greatly reduce the production of NO, and, accordingly, can have a significant effect on the overall production of $NO_x$.

Various attempts have been made to re-engineer conventional non-premixed combustion systems to reduce emissions of oxides of nitrogen ($NO_x$). Flames in non-premixed combustion, that is, the combustion process wherein fuel and oxidizer (typically air) mix and burn concurrently, generally emit unacceptable levels of $NO_x$, for example, over 200 parts-per-million (ppm), substantially higher than regulations allow for certain applications. The heating and power generation industries have recognized the need to develop cleaner, premixed combustion systems in which gaseous fuel and oxidizer (typically air) mix prior to burning.

The technical paper, Advanced Catalytic Pilot for Low $NO_x$ Industrial Gas Turbines, by Karim, et al., Published by the Proceedings of ASME TURBO EXPO 2002, Jun. 3-6, 2002, Amsterdam, The Netherlands, GT-2002-30083, discloses a catalytic pilot for use in a gas turbine combustor. A catalytic pilot incorporates catalyst-coated tubes to convert part of the fuel gas into combustion products on the surfaces of the tubes. The remainder of the pilot fuel gas and oxidant gas exits the pilot and mixes with fuel gas and oxidant gas from a main swirler to complete the combustion process downstream of the injector. In contrast to traditional pilot injectors, a catalytic pilot allows the operation of the pilot at leaner equivalence ratios. As a result, the inclusion of a catalytic pilot, as opposed to a more traditional pilot injector, provides a reduction in overall $NO_x$ levels. Additionally, the presence of a catalyst in the pilot may allow operation of the injector at overall leaner fuel-air ratios, resulting in lower flame temperatures, without combustion driven pressure oscillations.

Accordingly, there exists a need for alternative designs for fuel injectors that address the shortcomings of existing systems and/or that provide reduced $NO_x$ emissions. Such designs would be particularly advantageous if they were relatively simple and economical to scale, manufacture and operate.

BRIEF SUMMARY OF THE INVENTION

The disclosure describes, in one aspect, an injector for a gas turbine combustor. The injector includes an inner wall, at least one catalyst coated surface disposed within the inner wall and forming at least one passage adapted to provide a feed gas flow through the injector, and at least one channel disposed within the inner wall and adapted for passage of an oxidant gas flow through the injector. At least one of the feed gas flow or the oxidant gas flow establishes an axial gas flow through the inner wall and to the combustor. The injector further includes a flow conditioner disposed within the axial gas flow. The flow conditioner includes an elongated body having a length, an upstream end, a downstream end, an exterior surface at least partially disposed within the inner wall, and an interior passage for passage of the axial gas flow. The interior passage extends along the length of the flow conditioner, opening into the upstream and downstream ends and including an interior diameter. The interior diameter of the flow conditioner substantially smoothly reduces and then increases from the upstream end to the downstream end.

The disclosure further describes an injector for a gas turbine combustor wherein the injector comprises an inner wall, at least one catalyst coated surface disposed within the inner wall and forming at least one passage adapted to provide a feed gas flow through the injector, and at least one channel disposed within the inner wall and adapted for passage of an oxidant gas flow through the injector. At least one of the feed gas flow or the oxidant gas flow establishes an axial gas flow through the inner wall and to the combustor. The injector further includes a flow conditioner disposed within the axial gas flow. The flow conditioner includes an elongated body having a length, an upstream end, a downstream end, and an exterior surface along the length. At least a portion of the exterior surface is spaced away from and disposed within the inner wall, the exterior surface of the flow conditioner and the inner wall of the injector defining at least one substantially longitudinally extending channel for passage of the axial gas flow. The flow conditioner further includes an interior passage for passage of the axial gas flow. The interior passage extends along the length, and opens into the upstream and downstream ends and includes an interior diameter. The interior diameter substantially smoothly reduces and then increases from the upstream end to the downstream end.

Also disclosed is a method of conditioning gas flow through an injector assembly by establishing a flow of a feed gas through at least one pilot passage including at least one catalyst coated surface into a mix zone, establishing a flow of oxidant gas through at least one pilot channel into the mix zone, and establishing a flow of feed and oxidant gases from the mix zone through a flow conditioner. Establishing the flow of feed and oxidant gases from the mix zone through the flow conditioner includes establishing a flow of feed and oxidant gases from the mix zone through a plurality of vane channels formed between a plurality of substantially longitudinally extending vanes in an exterior surface of a flow conditioner, and establishing an axial flow of feed and oxidant gases from the mix zone through an interior passage along a length of the flow conditioner wherein the axial gas flow through the interior passage increases in velocity as an interior diameter of the interior passage substantially smoothly reduces, and the axial gas flow then decreases in velocity as the interior diameter substantially smoothly increases and then opens into a flame zone.

DETAILED DESCRIPTION

Figure 1:
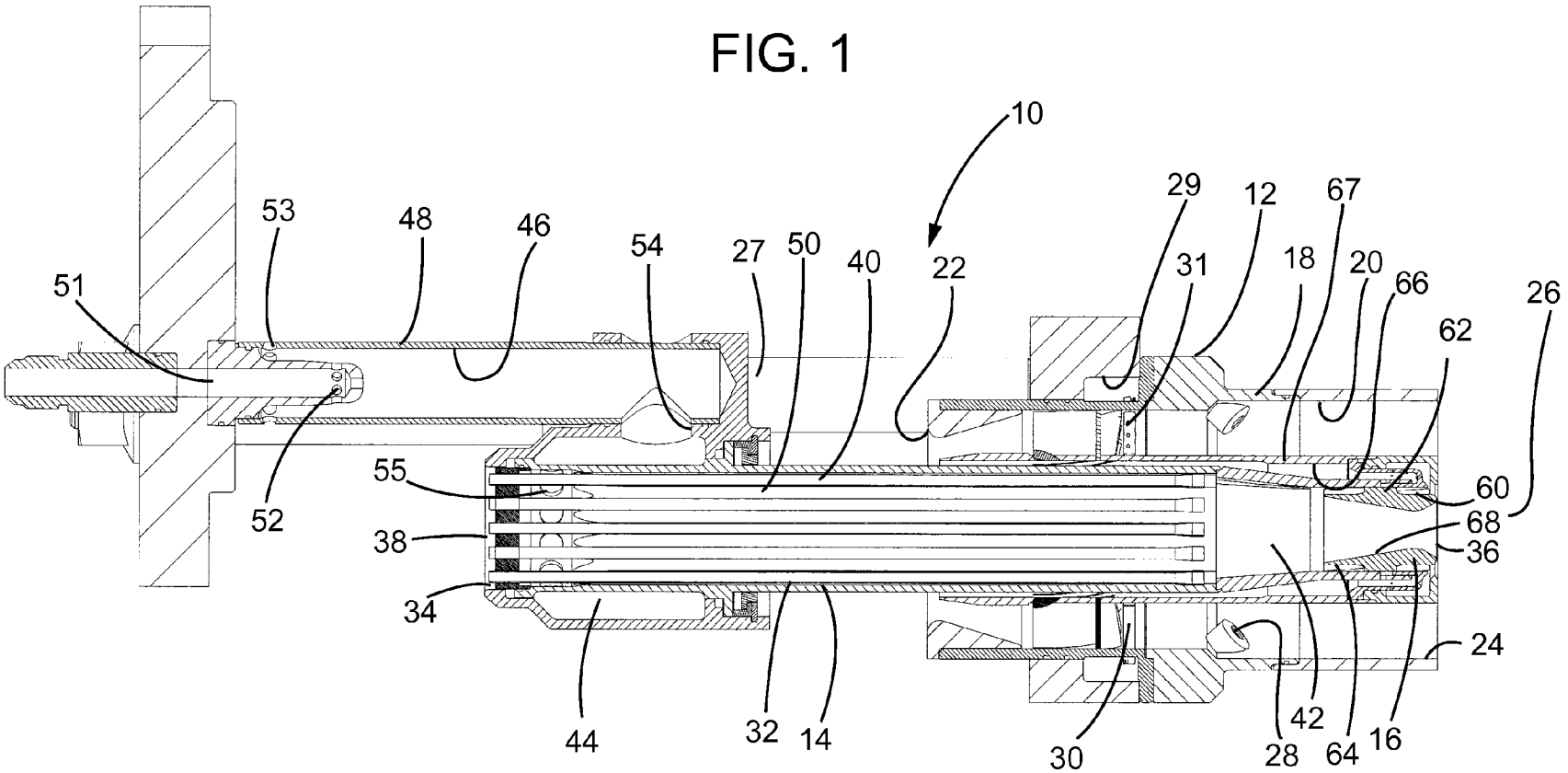
FIG. 1 is a cross-sectional view of an embodiment of an injector assembly according to the disclosure.

Turning now to the drawings, there is shown a cross-section of a fuel injector assembly 10 including a main injector 12 and a catalytic pilot 14 including a flow conditioner 16.

More specifically, in the illustrated embodiment, the injector 12 includes a housing 18 that forms at least one gas flow channel 20, or main swirl injector, having at least one upstream opening 22 and a downstream outlet 24 to a flame zone 26. The injector 12 itself may be of any appropriate design, including, for example, angled vanes to impart a swirl to the gasses flowing therethrough. The illustrated embodiment is adapted to utilize fuel gas or liquid fuel. In this regard, the housing 18 supports a plurality of nozzles 28 through which a liquid fuel may be provided. Alternately, fuel gas may be provided to the interior of the injector 12 by way of a supply line 27, which provides fuel to a circumferentially disposed plenum 29. The plenum 29 is fluidly connected to a plurality of radially disposed fuel supply spokes 30, which include a plurality of orifices 31. In this way, a flow of feed gas is provided from the supply line 27, through the plenum 29, spokes 30, and orifices 31 to the interior of the injector 12. A flow of oxidant gas is provided through the upstream opening 22 into the gas flow channel 20 where it is mixed with a flow of feed gas provided through the orifices 31 or the liquid fuel provided through the nozzles 28 before reaching the flame zone 26.

In the illustrated embodiment, the housing 18 further surrounds the catalytic pilot 14. The catalytic pilot 14 includes an annular pilot housing 32 having an upstream oxidant inlet 34, and a downstream outlet 36 through a gas flow channel 38. Although any appropriate design may be provided, in the illustrated embodiment, a plurality of longitudinally extending tubes 40, the exterior surfaces of which are catalyst coated, are disposed within the gas flow channel 38 to receive a flow of oxidant gas, typically air, from the upstream inlet 34 and to supply the same to a mix zone 42 downstream.

To supply a feed gas to the catalytic pilot 14, a plenum 44, here, an annular plenum, is provided, which fluidly connects a feed gas supply passage 46 in a supply line 48 with longitudinally extending passages 50 surrounding the catalyst-coated tubes 40 in the interior of the catalytic pilot 14. Flow of fuel gas into the supply line 48 is provided through a fitting 51, which includes a plurality of openings 52 into supply passage 46. Oxidant gas is further provided to the supply passage 46 by way of a plurality of openings 53 into the supply line 48. In this way, the fuel and oxidant gases mix within the supply passage 46 to yield the feed gas that flows to the plenum 44 by way of at least one opening 54. The feed gas within the plenum 44 flows on to the longitudinally extending passages 50 by way of at least one opening 55 in the interior of the catalytic pilot 14. Thus, the feed gas supply passage 46, the opening 54, the annular plenum 44, the plurality of openings 55, and the longitudinally extending passages 50 surrounding the tubes 40 in the interior of the catalytic pilot 14 together form a plurality of passages that supply feed gas to the mix zone 42 in the interior of the catalytic pilot 14 before flowing to the flame zone 26.

As the fuel gas flows along the catalyst-coated tubes, a portion of the fuel gas is converted into combustion products on the exterior surface of the tubes before reaching the mix zone 42 where it is combined with the oxidant gas flowing through the tubes 40. In the illustrated embodiment, the internal diameter of the mix zone 42 generally narrows, and then extends at a constant diameter before opening into the flame zone 26.

The arrangement of the catalytic pilot 14 is provided by way of example, however, and alternate arrangements are within the purview of the disclosure. By way of example only, although a pilot housing 32 of a generally circular cross-section is illustrated, the housing may have an alternate design or cross-section, such as an oval or octagonal cross-section. By way of further example, although a fuel gas is supplied to the supply passage 46 where it is mixed with oxidant gas supplied through the supply line 48, a premix of feed gas may be provided.

Figure 2:
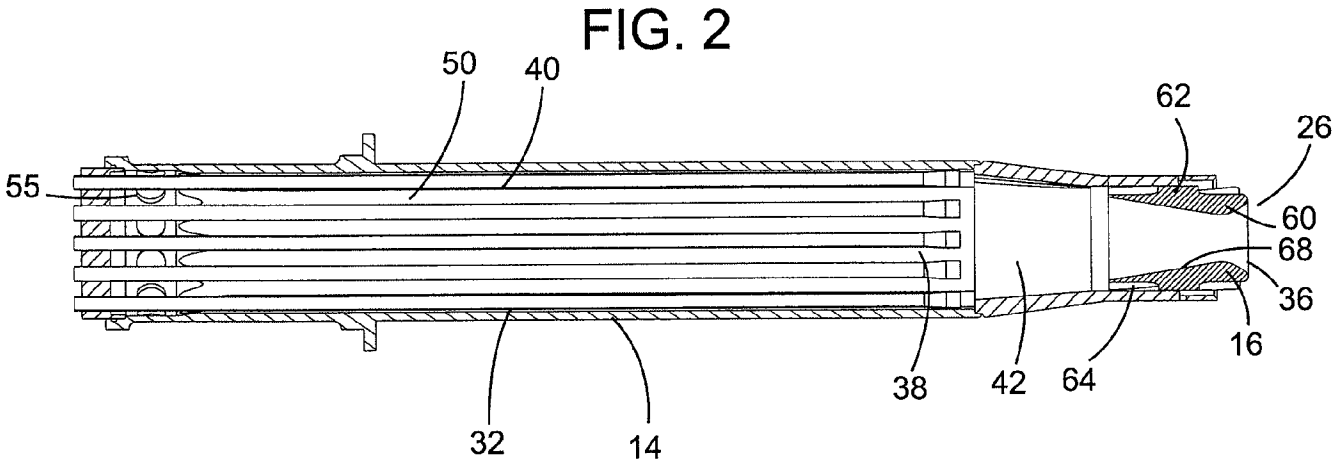
FIG. 2 is an enlarged, fragmentary, cross-sectional view of the catalytic pilot of FIG. 1 including the flow conditioner.
Figure 3:
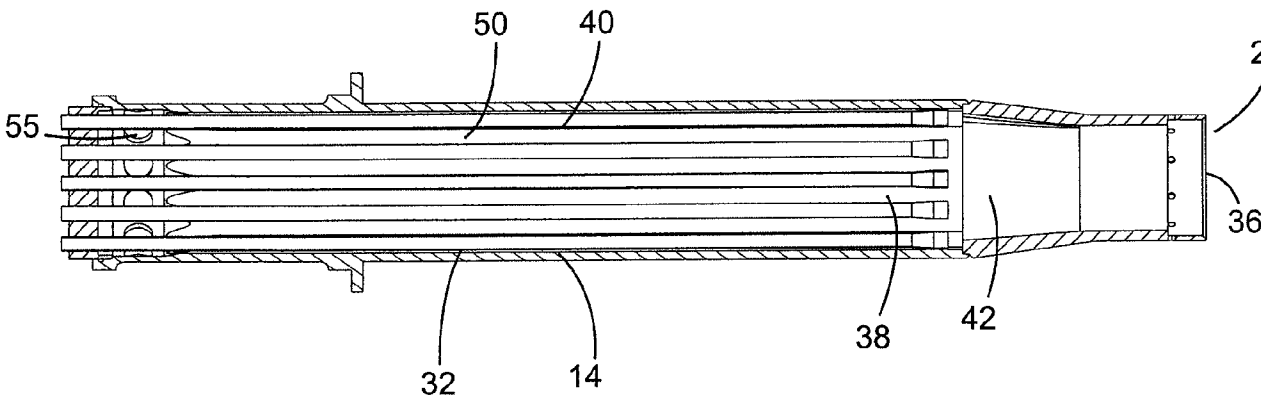
FIG. 3 is an enlarged, isometric view of the catalytic pilot of FIG. 2 without the flow conditioner.
Figure 4:
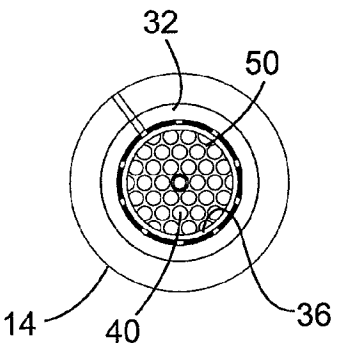
FIG. 4 is an end view of the catalytic pilot of FIG. 3.
Figure 6:
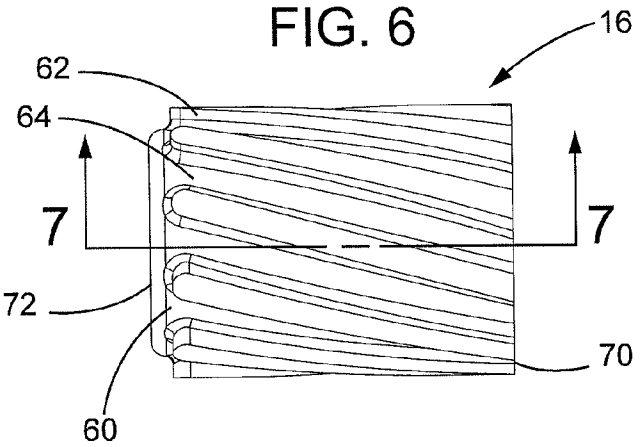
FIG. 6 is a side elevational view of the flow conditioner of FIG. 5.
Figure 7:
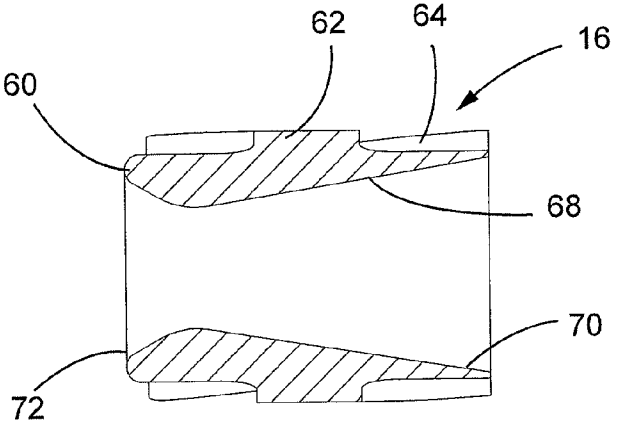
FIG. 7 is a cross-sectional view of the flow conditioner of FIGS. 5 and 6 taken along line 7-7 in FIG. 6.
Figure 5:
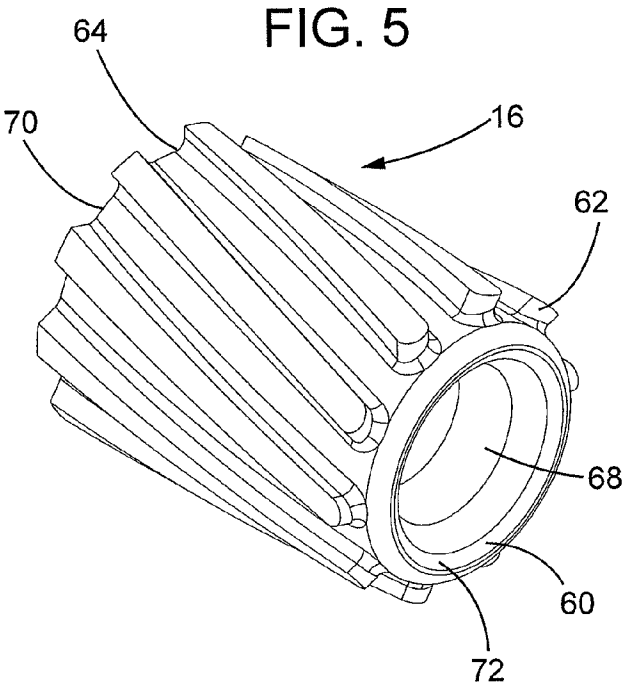
FIG. 5 is an isometric view of the flow conditioner of FIG. 2.

Gas flow through and from the pilot 14 is at least partially controlled by a flow conditioner 16 disposed downstream within the channel 38, as illustrated in FIGS. 1 and 2. As may be best seen in FIGS. 5-7, the flow conditioner 16 includes an elongated body 60 from which at least one vane 62 extends outwardly therefrom. In the illustrated embodiment, the elongated body 60 acts as a hub from which a plurality of vanes 62 extend. The radially outermost surfaces of the vanes 62 generally conform to the inner surface of the downstream end of the pilot housing 32 such that a plurality of elongated flow channels 64 are formed between the vanes 62, the pilot housing 32, and the elongated body 60. Alternate structures are envisioned to provide the elongated channels 64, however. In an alternate embodiment, for example, the vanes may be disposed to generally conform to a surface 66 (see FIG. 1) of an inner wall 67 of the injector housing 18, such that the channels are formed between the vanes 62 and the elongated body 60 of the flow conditioner 16, and the surface 66 of the injector housing 18. In order to impart an angular momentum or swirl to the gas flow exiting the flow channels 64, the vanes 62 are disposed in a generally spiral arrangement about the body 60. In this way, the flow through the elongated channels 64 allows the pilot flow to expand and mix with the flow from the injector channel 20.

Any appropriate number of vanes 62 may be provided, and the vanes 62 may have any appropriate structure and be disposed at any appropriate angle, so long as the vanes impart the desired angular momentum to the gas as it flows from the flow conditioner 16. In the embodiment illustrated in FIGS. 5-7, ten axial curved vanes 62 are disposed at a vane angle on the order of 10° to 25°, here, 15°.

A further flow of gas from the pilot 14 is provided through an interior passage 68 extending axially through the elongated body 60 of the flow conditioner 16. The interior passage 68 has an interior diameter and a length extending from an upstream end 70 to a downstream end 72. The diameter of the interior passage 68 generally decreases, and then increases along the length from to the upstream end 70 to the downstream end 72. In this way, the geometry of the interior passage 68 allows relatively high flow velocities at the core of the flow conditioner 16, and inhibits flame from the flame zone 26 from flashing back into the pilot 16, while the reduced flow velocity at the downstream end 72, where the flow expands, inhibits blow off in transient conditions.

The flow conditioner 16 may be constructed from metal, ceramic, or other rigid materials capable of withstanding the conditions.

The fuel gas may be any appropriate gas, such as, for example, natural gas. Likewise, the oxidant gas may be any appropriate gas, such as, for example, air. Further, the feed gas may be in the form of either pure fuel gas, or a mix or premix of fuel gas and oxidant gas.

The gas flow may be provided to the pilot 14 by any appropriate arrangement. For example, a oxidant gas or premix of fuel gas and oxidant gas may be provided to the upstream inlet 34 to the pilot housing 32 and/or to the inlet 22 to the housing 18. Alternately, separate fuel gas and oxidant gas may be provided to the housings 18, 32, or a combination of the same. In an embodiment, oxidant gas, typically air, is supplied to the housings 18, 32 through upstream openings 22, 34. Fuel gas may be introduced at any appropriate opening or location to mix with the oxidant gas, so long as adequate residence time is provided within the injector 12 and pilot 15 for efficient and effective oxidant gas/fuel gas mixing. Fuel gas may be provided through one or more passages or the like into the housings 18, 32.

INDUSTRIAL APPLICABILITY

An injector assembly 10 according to the disclosure may be utilized to achieve ultra-low $NO_x$ emissions in, for example, an industrial gas turbine. The injector assembly 10 may provide the advantages of an assembly including a catalytic pilot 14, while the flow conditioner 16 may yield a stable, compact pilot flame. The fuel injector assembly 12 including the catalytic pilot 14 and flow conditioner 16 may additionally provide acceptable radial profile and pattern factor at the inlet to the turbine.

Embodiments of the flow conditioner 16 for use in the assembly 10 may additionally inhibit or prevent flashback of the flame into the pilot 14 module. Embodiments of the flow conditioner 16 for use in the assembly 10 may additionally provide low pressure loss across the conditioner 16. In some embodiments, either or both of the catalytic pilot and the flow conditioner 16 may be provided as modules that may be readily replaced and/or serviced as necessary. Additionally, the flow conditioner 16 may be efficiently and economically manufactured and readily assembled into the injector assembly 10.

Figure 8:
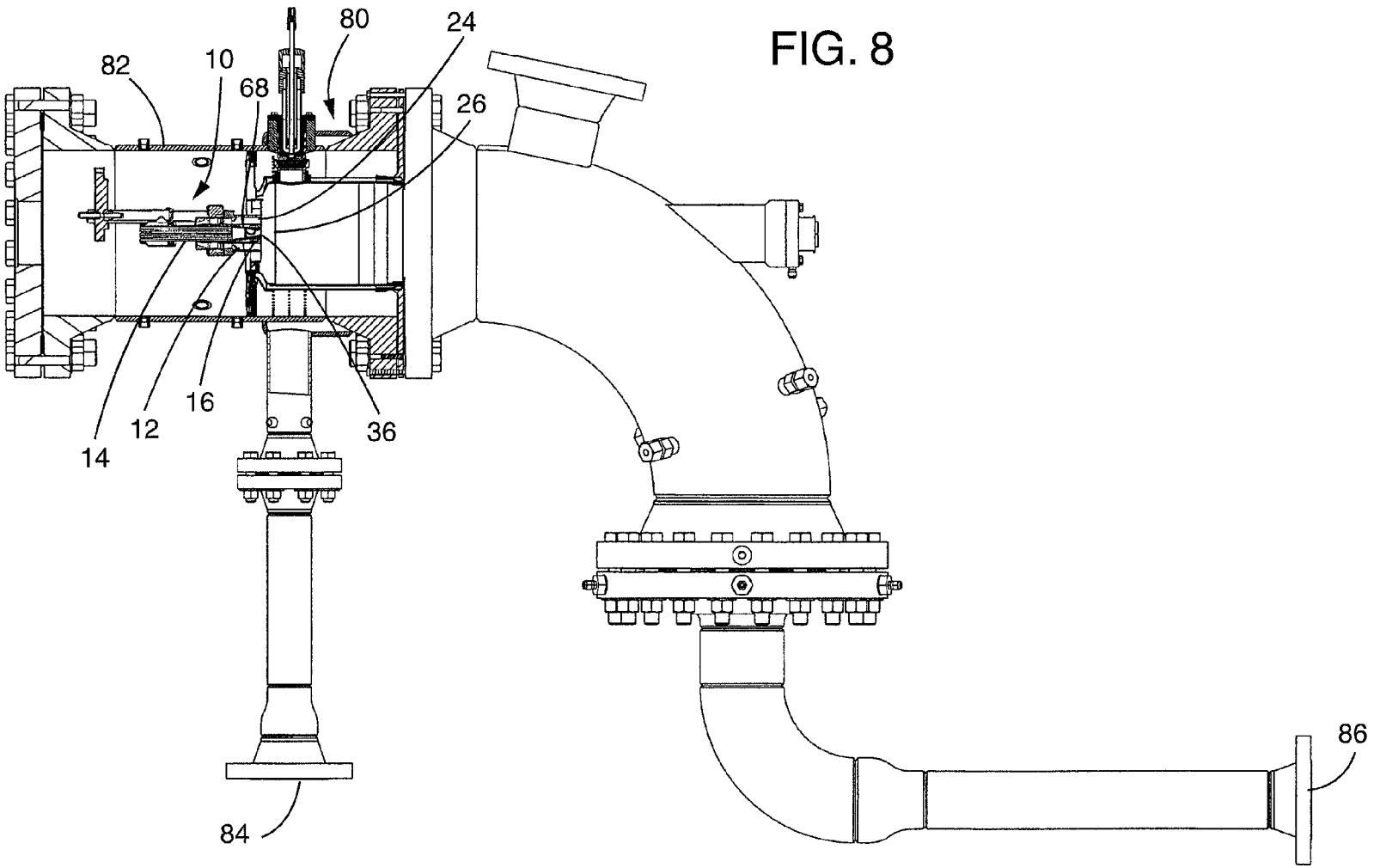
FIG. 8 is a partially cross-sectioned side view of a test rig incorporating an exemplary combustor including the injector assembly of FIG. 1.

Turning to FIG. 8, a test rig incorporating the disclosed fuel injector assembly 10 within a combustor 80 is illustrated. The fuel injector assembly 10 is disposed within a combustor housing 82 to which oxidant or air flow may be provided through an air inlet 84. In turn, exhaust gas may be expelled to outlet 86. In use, the gas flow exiting the main injector 12 and the catalytic pilot injector 14 interact at the flame zone 26. Upon ignition, a flame may be stabilized just downstream of the injector exit plane at the downstream outlet 24, 36.

The velocities of unburnt fuel gas and oxidant gas exiting a catalytic pilot injector not including flow conditioner 16 can be relatively high, which can result in a long and/or unstable flame. Gas flow through the interior passage 68 of the flow conditioner 16 of the catalytic pilot injector 14 of the disclosure, however, increases in velocity as the interior diameter of the interior passage 68 decreases, and then the velocity decreases as the interior diameter of the interior passage 68 increases before the flow enters the flame zone 26. Thus, in use, the flow conditioner 16 may inhibit or prevent the flame from flashing back into the catalytic pilot injector 14, while inhibiting blow-off during transient periods.

It will be appreciated that the foregoing description provides examples of the disclosed system and technique. However, it is contemplated that other implementations of the disclosure may differ in detail from the foregoing examples. All references to the invention or examples thereof are intended to reference the particular example being discussed at that point and are not intended to imply any limitation as to the scope of the invention more generally. All language of distinction and disparagement with respect to certain features is intended to indicate a lack of preference for those features, but not to exclude such from the scope of the invention entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. An injector for a gas turbine combustor comprising:

an inner wall, at least one catalyst coated surface disposed within said inner wall and forming at least one passage adapted to provide a feed gas flow through the injector, at least one channel disposed within said inner wall and adapted for passage of an oxidant gas flow through the injector, at least one of the feed gas flow or the oxidant gas flow establishing an axial gas flow through the inner wall and to the combustor, a mix zone downstream of the channel and the passage wherein the oxidant gas flow and feed gas flow mix, a flow conditioner disposed within said axial gas flow downstream of the mix zone, said flow conditioner including an elongated body having a length, an upstream end, a downstream end, an exterior surface at least partially disposed within the inner wall, and an interior passage for passage of said axial gas flow, the interior passage extending along the length, opening into the upstream and downstream ends and including an interior diameter, the interior diameter substantially smoothly reducing and then increasing from the upstream end to the downstream end, wherein the exterior surface of the flow conditioner includes a plurality of vanes, the vanes and the inner wall defining at least one substantially longitudinally extending channel for passage of said axial gas flow.

2. The injector of claim 1 wherein the injector includes a main injector and a catalytic pilot injector.

3. The injector of claim 2 wherein the inner wall is formed by the catalytic pilot injector.

4. The injector of claim 2 wherein the inner wall is formed by the catalytic pilot injector and the main injector, and the flow conditioner is disposed at least partially within the inner wall formed by the catalytic pilot injector.

5. The injector of claim 2 wherein the catalytic pilot injector is disposed at least partially within the main injector.

6. The injector of claim 1 wherein the vanes are disposed in a substantially spiral arrangement around the exterior surface.

7. An injector for a gas turbine combustor comprising:

an inner wall, at least one catalyst coated surface disposed within said inner wall and forming at least one passage adapted to provide a feed gas flow through the injector, at least one channel disposed within said inner wall and adapted for passage of an oxidant gas flow through the injector, at least one of the feed gas flow or the oxidant gas flow establishing an axial gas flow through the inner wall and to the combustor, a mix zone downstream of the channel and the passage wherein the oxidant gas flow and feed gas flow mix, a flow conditioner disposed within said axial gas flow downstream of the mix zone, said flow conditioner including an elongated body having a length, an upstream end, a downstream end, an exterior surface along the length, at least a portion of the exterior surface being spaced away from and disposed within the inner wall, the exterior surface of the flow conditioner and the inner wall of the injector defining at least one substantially longitudinally extending channel for passage of said axial gas flow, wherein the exterior surface includes a plurality of substantially longitudinally extending vanes including an outer perimeter configured to be disposed within the inner wall, the at least one substantially longitudinally extending channel of the flow conditioner including a plurality of substantially longitudinally extending vane channels for passage of said axial gas flow, and an interior passage for passage of said axial gas flow, the interior passage extending along the length, opening into the upstream and downstream ends and including an interior diameter, the interior diameter substantially smoothly reducing and then increasing from the upstream end to the downstream end.

8. The injector of claim 7 including at least one longitudinally extending tube having an interior and an exterior, the interior of the tube forming said at least one channel and the exterior forming the at least one catalyst coated surface.

9. The injector of claim 7 wherein the vanes are disposed in a substantially spiral arrangement about the exterior surface.

10. The injector of claim 7 wherein the vanes are disposed at a vane angle on the order of 10° to 25°.

11. The injector of claim 10 wherein the vanes are disposed at a vane angle on the order of 15°.

12. The injector of claim 7 wherein the interior diameter reduces on the order of 35% to 50%.

13. The injector of claim 7 wherein the interior diameter reduces over 75% to 90% of the length before increasing.

14. The injector of claim 7 wherein the vanes are disposed at a vane angle on the order of 10° to 25°, the interior diameter reduces on the order of 35% to 50%, over 75% to 90% of the length of the flow conditioner.

15. The injector of claim 7 further including a main swirl injector disposed about the flow conditioner.

* * * * *